US006276668B1

(12) United States Patent
Sweeley

(10) Patent No.: US 6,276,668 B1
(45) Date of Patent: Aug. 21, 2001

(54) ROOF SAFETY BRACKET SYSTEM

(76) Inventor: William L. Sweeley, 130 E. Main St., P.O. Box 549, Millheim, PA (US) 16854

( * ) Notice: Subject to any disclaimer, the term of this patent is extended or adjusted under 35 U.S.C. 154(b) by 0 days.

(21) Appl. No.: 09/306,102

(22) Filed: May 6, 1999

Related U.S. Application Data

(60) Provisional application No. 60/091,638, filed on Jul. 2, 1998.

(51) Int. Cl.[7] ..... E04H 17/14

(52) U.S. Cl. ..... 256/59; 256/DIG. 6

(58) Field of Search ..... 256/1, 59, 61, 256/62, 69, 71, DIG. 6, DIG. 2, 25, 31

(56) References Cited

U.S. PATENT DOCUMENTS

| | | | | |
|---|---|---|---|---|
| 3,480,257 | * | 11/1969 | Bourn et al. | 256/59 |
| 3,747,898 | * | 7/1973 | Warren | 256/59 |
| 3,841,609 | * | 10/1974 | Smith | 256/59 |
| 3,863,899 | * | 2/1975 | Werner | 256/59 X |
| 3,863,900 | * | 2/1975 | Dagiel et al. | 256/59 |
| 3,995,833 | * | 12/1976 | McLaughlin et al. | 256/59 |
| 3,995,834 | * | 12/1976 | Melfi | 256/59 |
| 4,301,627 | * | 11/1981 | Wilson | 256/69 X |
| 4,623,126 | * | 11/1986 | Pettit | 256/25 X |
| 4,666,131 | | 5/1987 | Kettelkamp, Sr. et al. . | |
| 4,669,577 | * | 6/1987 | Werner | 256/59 X |
| 4,979,725 | | 12/1990 | Hutchings, II et al. . | |
| 5,314,167 | | 5/1994 | Holloman . | |
| 5,353,891 | * | 10/1994 | Griek et al. | 256/59 X |
| 5,570,559 | | 11/1996 | Lewis . | |
| 5,573,227 | | 11/1996 | Hemauer et al. . | |
| 5,638,917 | | 6/1997 | Vennen . | |
| 5,653,308 | * | 8/1997 | White | 256/31 X |
| 5,711,398 | | 1/1998 | Bartholomew . | |
| 6,038,829 | * | 3/2000 | Franks | 256/59 X |
| 6,053,281 | * | 4/2000 | Murray | 256/59 X |

FOREIGN PATENT DOCUMENTS

| | | | | |
|---|---|---|---|---|
| 2441696 | * | 7/1980 | (FR) | 256/DIG. 6 |
| 2661932 | * | 11/1991 | (FR) | 256/59 |

OTHER PUBLICATIONS

Unknown, "The Practical Answer to Edge Protection The Safety Roof Rail PR 100," Protective Roofing Products Ltd (Ontario, Canda), p. 4.

* cited by examiner

*Primary Examiner*—Lynne H. Browne
*Assistant Examiner*—David E. Bochna
(74) *Attorney, Agent, or Firm*—John J. Elnitski, Jr.

(57) ABSTRACT

A system to protect workmen from falling from a roof. It is especially useful for flat roofs. The main components of the roof safety bracket system are brackets and safety line. Each bracket has a cross-member having a first and second end. The cross-member at its first end extends forward from the first upright near the top of the first upright. Each bracket has a second upright attached to the second end of the cross-member. There is a roof attachment unit including a roof plate and an upright attachment plate. The roof plate extends forward from the first upright and the upright attachment plate extends downward along the first upright from the roof plate. Each bracket includes a receiver box extending from the bottom of the first upright and a horizontal stabilizer. The horizontal stabilizer includes an adjustment bar and face plate, where the adjustment bar adjustably fits into the receiver box. A series of such brackets are set on a roof with safety line between the brackets to aid in the prevention of someone falling off a roof.

20 Claims, 5 Drawing Sheets

ROOF SAFETY BRACKET SYSTEM

This application claims the benefit of U.S. Provisional Application No.: 60/091,638 filed Jul. 2, 1998.

BACKGROUND

Federal and state regulations require roof safety systems to prevent workmen from falling from a roof during the construction or repair of the roof. These roof safety systems are necessary especially on commercial buildings that are normally more than one story above ground level. Most of the roof safety systems are not compatible for use on flat type roofs.

It is an object of the present invention to provide a roof safety system which provides protection to workmen on a roof, is inexpensive, easy to transport, and easy to install and remove.

It is another object of the present invention to provide a roof safety system for use on a flat type roof.

SUMMARY

The present invention is a roof safety system utilizing a bracket which includes a first upright having a top and bottom. The bracket has a cross-member having a first and second end. The cross-member at its first end extends forward from the first upright near the top of the first upright. The bracket has a second upright attached to the second end of the cross-member. There is a roof attachment unit including a roof plate and an upright attachment plate. The roof plate extends forward from the first upright and the upright attachment plate extends downward along the first upright from the roof plate. The bracket includes a receiver box extending from the bottom of the first upright and a horizontal stabilizer. The horizontal stabilizer includes an adjustment bar and face plate, where the adjustment bar adjustably fits into the receiver box. A series of such brackets can be set on a roof with safety line between the brackets to aid in the prevention workmen from off a roof. The bracket is easy to transport, install and remove from a roof.

DESCRIPTION OF THE INVENTION

Figure 1:
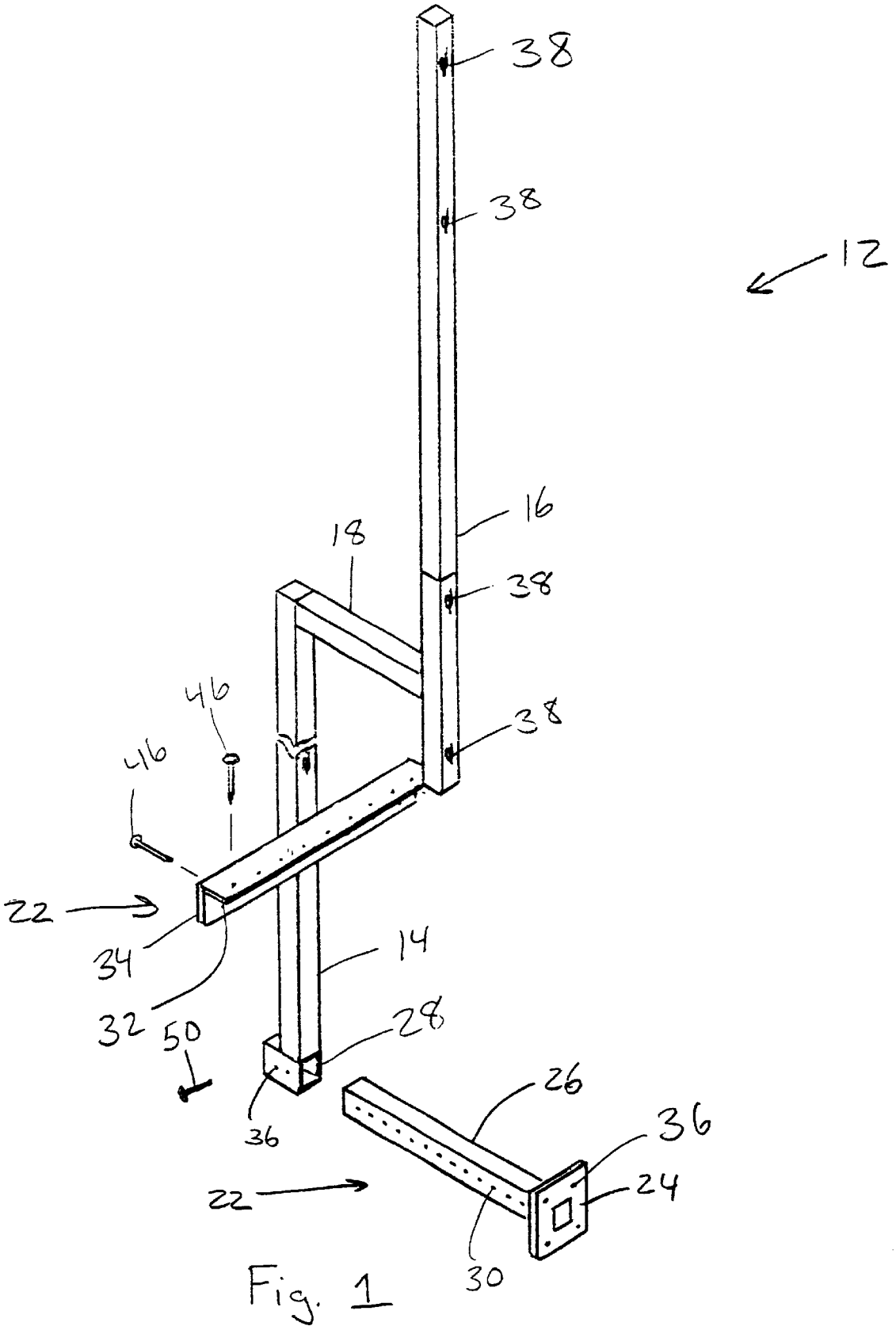
FIG. 1 is a perspective view of a bracket according to the present invention.
Figure 2:
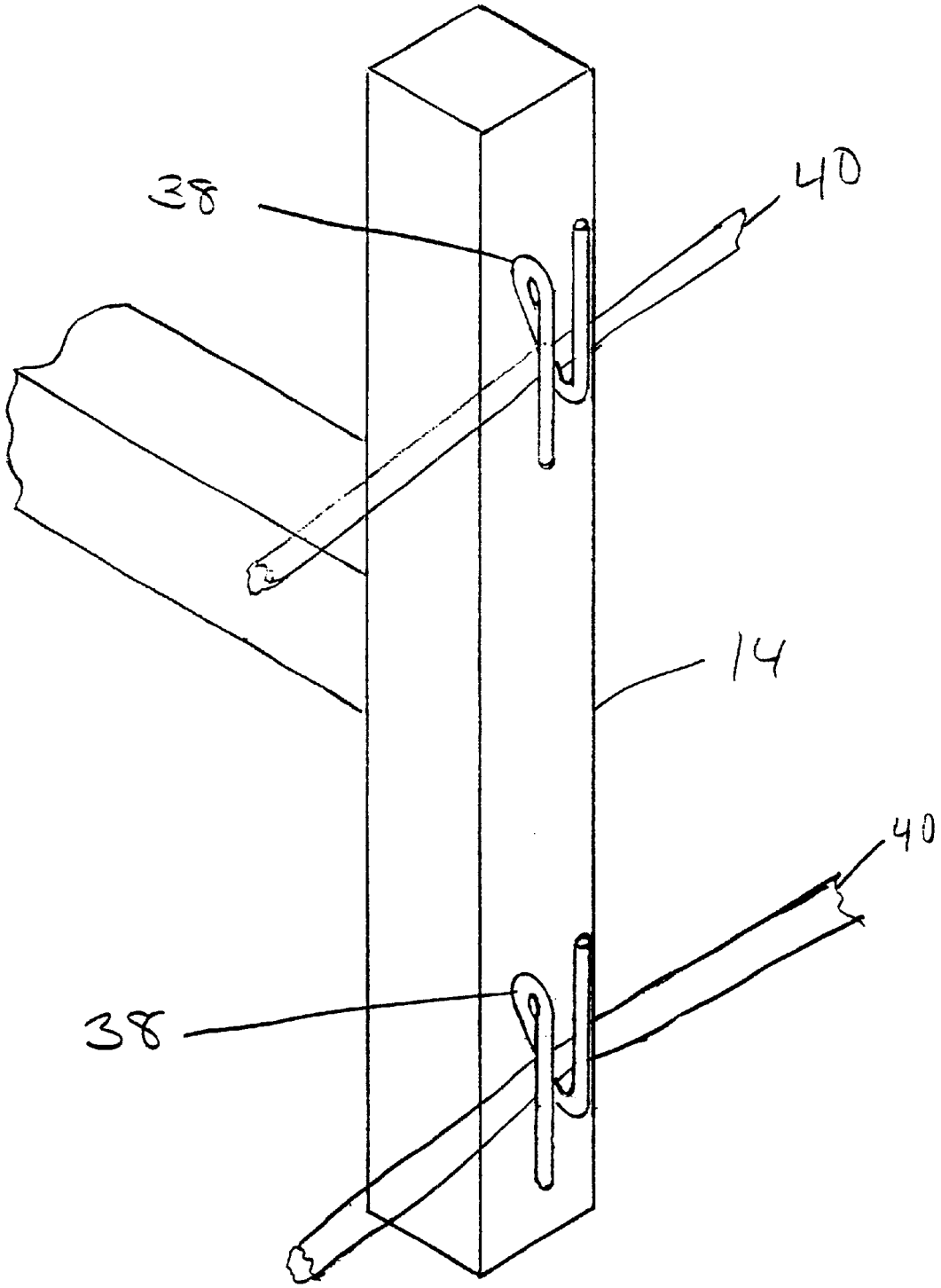
FIG. 2 is a perspective view of a second upright of a bracket according to the present invention.
Figure 3:
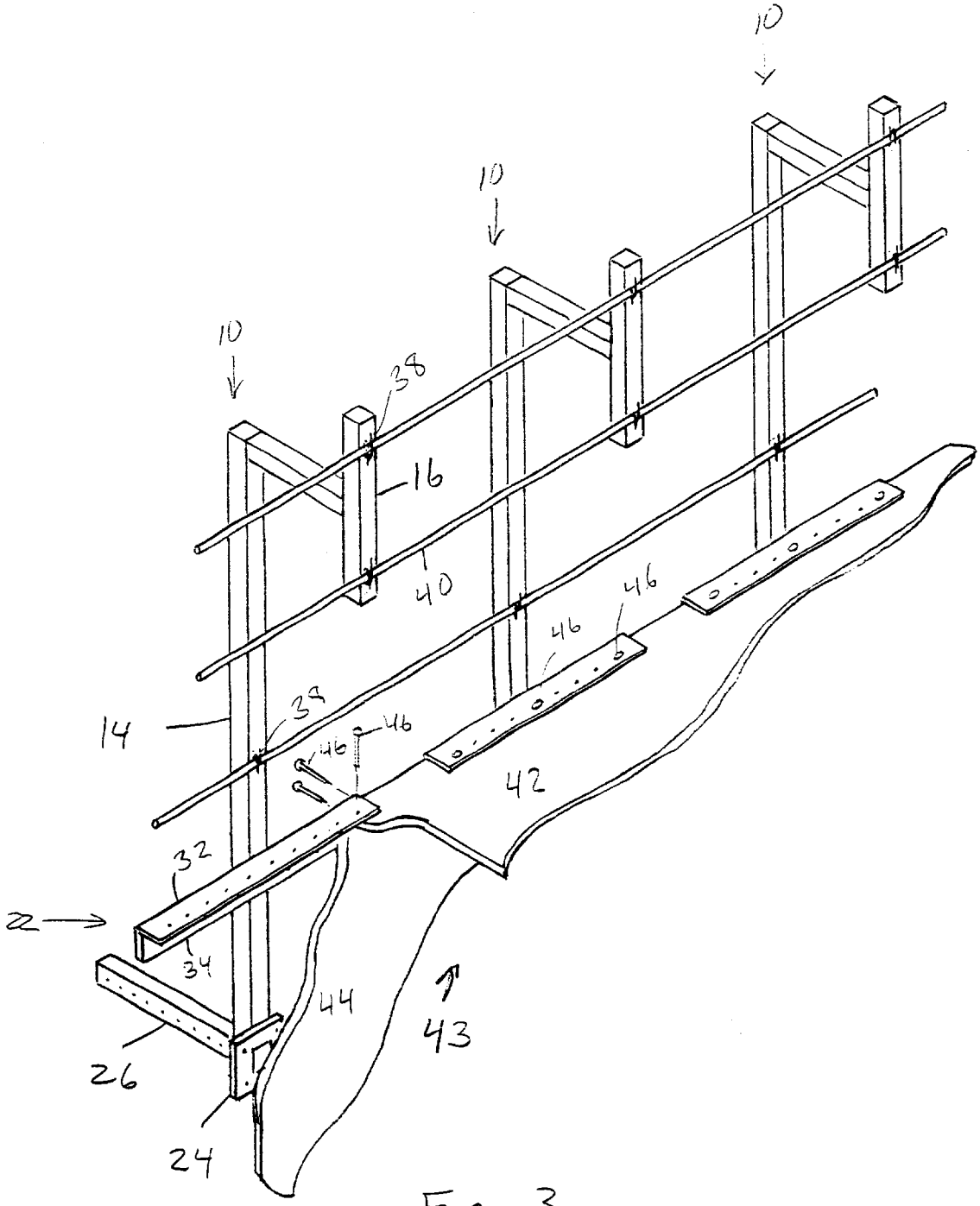
FIG. 3 is a perspective view of a series of brackets mounted to a roof according to the present invention.
Figure 4:
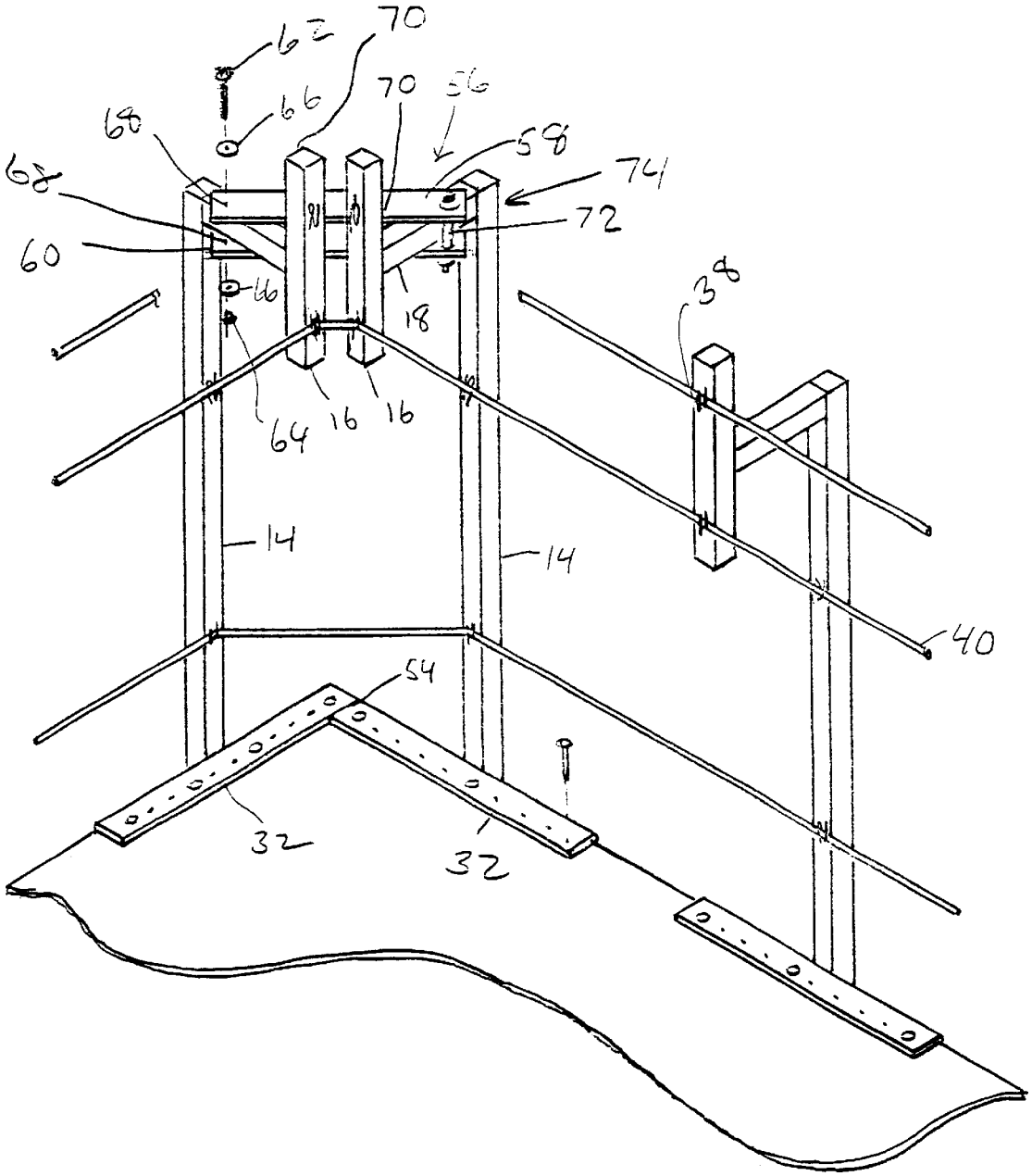
FIG. 4 is a perspective view of two brackets mounted to a roof to form a corner according to the present invention.
Figure 5:
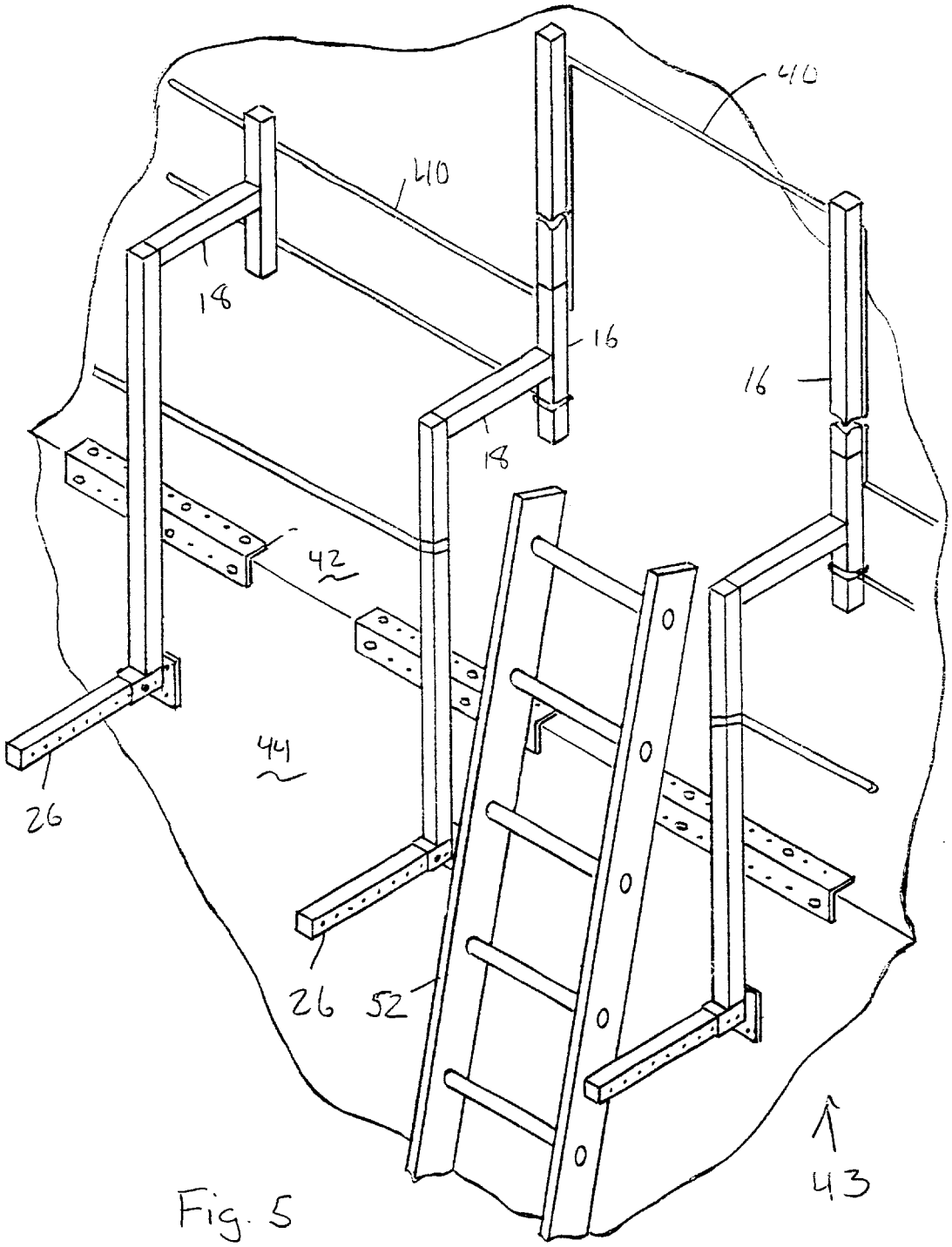
FIG. 5 is a perspective view of two brackets mounted to a roof to form an entrance according to the present invention.

The present invention is a roof safety bracket system to protect workmen from falling from a roof. It is especially useful for flat roofs. FIGS. 1–5 show the main components of the roof safety bracket system. The main components of the roof safety bracket system are brackets and safety line. FIGS. 3–5 show a mainline bracket 10, while FIGS. 1 and 5 show an entrance/exit bracket 12. The mainline and entrance/exit brackets 10, 12 are the same except that the entrance/exit bracket 12 is taller. As shown in FIGS. 1–5, each bracket 10, 12 includes a first upright 14, a second upright 16, a cross-member 18, roof attachment unit 20 and horizontal stabilizer 22. As see in FIGS. 1–5, the entrance/exit bracket 12 has a longer second upright 16 than does the mainline bracket 10, which makes the entrance/exit bracket 12 taller.

The horizontal stabilizer 22 includes a face plate 24 attached to an adjustment bar 26. The first upright 14 includes a receiver box 28 to receive the adjustment bar 26 of the horizontal stabilizer 22. The adjustment bar 26 is sized to move inside of the receiver box 28. Both the receiver box 28 and the adjustment bar 26 include adjustment holes 30 to adjust the distance of the face plate 24 from the first upright 14. The roof attachment unit 20 is shown in a right angle configuration having a roof plate 32 and an upright attachment plate 34 which are at right angles to each other. The upright attachment plate 34 attaches to the first upright 14 and is perpendicular lengthwise to the first upright 14. The upright attachment plate 34 can be attached to the first upright 14 by welding or bolting the two together. The upright attachment plate 34 includes fastener holes 36. The roof plate 32 also runs perpendicular lengthwise to the first upright 14 and includes fastener holes 36. The cross-member 18 is interconnected between the first and second uprights 14, 16 and provides support for the second upright 16. The second upright 16 includes two rows of safety line attachment loops 38 on the mainline bracket 10 and four safety line attachment loops on the entrance/exit bracket 12. Shown in the enlarge view of FIG. 2, the safety line attachment loops 38 allow safety line 40 to be easily inserted into the loops 38. Also shown in FIGS. 1 and 3–5, the first upright 14 includes a safety line attachment loop 38 for the running of a lower safety line 40.

FIGS. 3–5 show the brackets 10, 12 attached to a roof 42 of a building 43 with the safety line 40 installed. Either bracket 10, 12 is installed by positioning the roof attachment unit 20 on top of the roof 42 and the side 44 of the building 43. To secure the brackets 10, 12 to a roof 42, fasteners 46 such as nails or screws are inserted into the fastener holes 36 and driven into the side 44 or roof 42 of the building 43. Next, the adjustment bar 26 of the horizontal stabilizer 22 is positioned so that the face plate 24 is against the side 44 of the building 43. A pin 50 is then inserted into one of the adjustment holes 30 to lock the horizontal stabilizer 22 in place. The face plate 24 can also include fastener holes 36 to fasten the plate 24 to the side 44 of the building 43 using fasteners 46. Finally, the safety line 40 is inserted in the safety line attachment loops 38 of the first and second uprights 14, 16. The safety line 40 should be tied so that each row of safety line 40 is taut, in order to prevent a workmen from falling off the roof 42. FIGS. 1 and 2–5 show three rows of safety line 40, but more or less rows of loops 38 and safety line 40 could be used. FIG. 5 shows the entrance/exit bracket 16 in use, where workmen would access the roof 42 using a ladder 52. As shown in FIG. 5, the upper of three safety lines 40 on a first entrance/exit bracket 12 runs upward to the highest loop 38 on the same second upright 16. Then, the safety line 40 continues on to the highest loop 38 of the second upright 16 of a second entrance/exit bracket 12. Finally, the safety line 40 runs downward to the next loop 38 of the second upright 16 of the second entrance/exit bracket 12. The middle and lower safety lines 40 end at each entrance/exit bracket 12. This arrangement allows workmen to pass when entering or exiting the roof area. When the entrance/exit is not in use, a removable safety rope or chain (not shown) can be utilized at the middle and lower loops 38.

FIG. 4 shows a comer arrangement of the mainline brackets 10. As shown, ends 54 of the roof attachment units 20 of two brackets 10 are butted together at a ninety degree (90°) angle. A comer brace 56 is used to secure two brackets 10 together. The comer brace 56 includes a top plate 58, bottom plate 60, bolts 62, nuts 64 and washers 66. The top plate 58 is positioned above each bracket cross-member 18 and the bottom plate 60 is positioned below each cross-member 18, whereby the top and bottom plates 58, 60 sandwich the cross-members 18 of each bracket 10. The top and bottom plates 58, 60 includes bolt holes 68. The bolt holes 68 are positioned so that when the top and bottom plates 58, 60 are against the rear face 70 of each second upright 16, the body 72 of the bolts 62 are against the cross-members 18 as shown at position 74. The positioning of the comer brace 56 as described above locks the brace 56 in place, thereby securing the two brackets 10 together. The comer brace 56 could also be used with the entrance/exit brackets 12.

While different embodiments of the invention has been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of the appended claims and any and all equivalents thereof.

I claim:

1. A roof safety bracket comprising:

a first upright having a top and bottom;

a cross-member having a first and second end, said cross-member extending forward from said first upright near said top of said first upright at said first end of said cross-member;

a second upright attached to said second end of said cross-member;

a roof attachment unit including a roof plate and an upright attachment plate;

said roof plate extending forward from said first upright;

said upright attachment plate extending downward along said first upright from said roof plate;

a receiver box extending from said bottom of said first upright; and a horizontal stabilizer including an adjustment bar and face plate, where said adjustment bar adjustably fits into said receiver box.

2. The roof safety bracket of claim 1, further including adjustment holes in said receiver box and said adjustment bar, said adjustment holes of said receiver box and said adjustment holes of said adjustment bar aligned by movement of said adjustment bar in said receiver box.

3. The roof safety bracket of claim 1, further including at least one safety line attachment loop on said second upright.

4. The roof safety bracket of claim 1, further including at least one safety line attachment loop on said first upright.

5. The roof safety bracket of claim 1, wherein said first upright and second upright are parallel to each other.

6. The roof safety bracket of claim 1, wherein said roof plate includes at least one fastener hole.

7. The roof safety bracket of claim 1, wherein said upright attachment plate includes at least one fastener hole.

8. The roof safety bracket of claim 1, wherein said face plate includes at least one fastener hole.

9. A roof safety system comprising:

at least two roof safety brackets;

said roof safety brackets including a first upright having a top and bottom, a cross-member having a first and second end, said cross-member extending forward from said first upright near said top of said first upright at said first end of said cross-member, a second upright attached to said second end of said cross-member, a roof attachment unit including a roof plate and an upright attachment plate, said roof plate extending forward from said first upright, said upright attachment plate extending downward along said first upright from said roof plate, a receiver box extending from said bottom of said first upright, and a horizontal stabilizer including an adjustment bar and face plate, where said adjustment bar adjustable fits into said receiver box; and safety line connected between said roof safety brackets.

10. The roof safety system of claim 9, wherein at least one of said roof safety brackets includes a second upright that is longer than said second uprights of said other roof safety brackets.

11. The roof safety system of claim 9, further including a corner brace comprising a top plate having two ends and a hole at each end, bottom plate having two ends and a hole at each end, and two bolts and nuts to secure said cross-members of two safety brackets between said top and bottom plates.

12. The roof safety system of claim 9, further including adjustment holes in said receiver box and said adjustment bar.

13. The roof safety system of claim 9, further including at least one safety line attachment loop on said second upright of said roof safety brackets.

14. The roof safety system of claim 9, further including at least one safety line attachment loop on said first upright of said roof safety brackets.

15. The roof safety system of claim 9, wherein said roof plate and said attachment plate each includes at least one fastener hole.

16. The roof safety system of claim 9, wherein said face plate includes at least one fastener hole.

17. A method of assembling a roof safety system comprising:

placing a plurality of roof safety brackets on a roof, said roof safety brackets including a first upright having a top and bottom, a cross-member having a first and second end, said cross-member extending forward from said first upright near said top of said first upright at said first end of said cross-member, a second upright attached to said second end of said cross-member, a roof attachment unit including a roof plate and an upright attachment plate, said roof plate extending forward from said first upright, said upright attachment plate extending downward along said first upright from said roof plate, a receiver box extending from said bottom of said first upright, and a horizontal stabilizer including an adjustment bar and face plate, where said adjustment bar adjustably fits into said receiver box;

attaching said roof attachment unit of said roof using a fastening means for securing said roof attachment unit to said roof;

adjusting the adjustment bar of said horizontal stabilizer in said receiver box such that said face plate is against a wall of a building under said roof; and connecting safety line between said roof safety brackets.

18. The method of claim 17, further including positioning two of said roof safety brackets on a comer of said roof at about ninety degrees to each other to form a comer bracket and mounting a comer brace to said two roof safety brackets to secure said two roof safety brackets together.

19. The method of claim 18, wherein said comer bracket includes a top plate having two ends and a hole at each end, bottom plate having two ends and a hole at each end, and two bolts and nuts.

20. The method of claim 17, further including at least one safety line attachment loop on at least one of said first and second upright.

* * * * *